United States Patent [19]

Grossiord et al.

[11] Patent Number: 4,484,888

[45] Date of Patent: Nov. 27, 1984

[54] ADJUSTABLE EXPANDER-EVAPORATOR AND VARIABLE MAXIMUM FLOW LIMITER FOR A LIQUIFIED GAS LIGHTER

[75] Inventors: Claude R. Grossiord, Annecy; Jean P. Molliex, Seynod, both of France

[73] Assignee: S. T. Dupont, Paris, France

[21] Appl. No.: 427,349

[22] Filed: Sep. 29, 1982

[30] Foreign Application Priority Data

Oct. 16, 1981 [FR] France ..... 81 19544

[51] Int. Cl.[3] ..... F23D 13/04

[52] U.S. Cl. ..... 431/344; 431/143; 431/131; 251/121; 251/DIG. 1; 222/3

[58] Field of Search ..... 431/344, 131, 133, 143, 431/142, 277; 251/120, 121; 222/3

[56] References Cited

U.S. PATENT DOCUMENTS

| | | | |
|---|---|---|---|
| 2,737,037 | 3/1956 | Zellweger | 431/344 |
| 3,183,686 | 5/1965 | Tissot-Dupont | 431/344 |
| 3,186,603 | 6/1965 | Burchett | 222/189 |
| 3,418,821 | 12/1968 | Remy et al. | 431/344 |
| 3,663,152 | 5/1972 | Yoshida | 431/344 |
| 3,705,785 | 12/1972 | Goto | 431/344 |
| 3,711,241 | 1/1973 | Obata | 431/344 |
| 4,101,262 | 7/1978 | Neyret | 431/344 |
| 4,157,891 | 6/1979 | Moriya | 431/344 |
| 4,311,450 | 1/1982 | Camos | 431/142 |

FOREIGN PATENT DOCUMENTS

| | | | |
|---|---|---|---|
| 2452494 | 5/1975 | Fed. Rep. of Germany | 431/344 |
| 1081399 | 7/1953 | France . | |
| 1151791 | 2/1958 | France | 431/142 |
| 1284230 | 3/1961 | France . | |
| 2397599 | 7/1977 | France . | |
| 2500587 | 8/1982 | France | 431/131 |

*Primary Examiner*—Samuel Scott
*Assistant Examiner*—Helen Ann Odar
*Attorney, Agent, or Firm*—Robert A. Shack

[57] ABSTRACT

A valve for a liquefied gas lighter, which includes an expander-evaporator and a flow limiter for limiting flow of the liquefied gas to the expander-evaporator, the flow limiter including a rigid member, a deformable sleeve of a gas permeable material surrounding the rigid member, an elastically deformable element in contact with the sleeve, and a compression member for compressing the elastically deformable element and deforming it radially in the direction of the sleeve and the rigid member. The rigid member includes a support member for supporting the sleeve and the expander-evaporator, the elastically deformable member is an O-ring surrounding the sleeve, and the expander-evaporator is a deformable and permeable element whose permeability is varied by movement of the rigid member, effected through an adjustment member.

4 Claims, 3 Drawing Figures

ADJUSTABLE EXPANDER-EVAPORATOR AND VARIABLE MAXIMUM FLOW LIMITER FOR A LIQUIFIED GAS LIGHTER

BACKGROUND OF THE INVENTION

1. Field of the Invention

The present invention relates to liquefied gas lighters.

2. Description of the Prior Art

Lighters of this type typically employ an expander-evaporator, designed to ensure conversion of the gas from the liquid phase in which it is stored to the vapor phase in which it is dispensed. The expander-evaporator also serves to reduce the gas pressure to a desired delivery pressure.

In order to improve the safety of these lighters, it is known to limit the maximum flame height which they can deliver by disposing a flow-limiting device upstream of the expander-evaporator.

These flow limiters, because of their location upstream of the expander-evaporator, reduce the flow of the gas in the liquid phase. A given volume of liquid gas, after evaporation, produces a gas-phase volume which is approximately five times larger. Consequently, the restriction presented by such a flow limiter must be considerable in comparison with the restriction presented by the expander-evaporator.

Therefore, when these flow limiters are made of a permeable and compressible material through which the gas passes, they must be quite severely compressed to produce a sufficient flow restriction.

In a known flow limiter, a cylindrical wick is disposed centrally of an annular rubber plug. Compressing the rubber plug compresses the wick to decrease its permeability.

In another known flow limiter, a wick is disposed around a solid rubber plug, whose deformation due to compression thereof affects the permeability of the surrounding wick.

In these known flow limiters, the forces involved can reach the point where they cause the elastic element to become permanently deformed, resulting in an unintended release of the compression exerted on the permeable wick and a corresponding increase in the maximum flame produced by the lighter. If severe permanent distortion occurs, the flow limiting effect can be completely negated.

Additionally, the powerful compression required for the elastic element means that the preregulation system must be very sturdy, excluding for all practical purposes simple adjustment by the user of the maximum flame obtainable.

SUMMARY OF THE INVENTION

An object of the present invention is to overcome the above-mentioned disadvantages by providing a flow limiter, wherein an elastic element need not be acted on by a considerable compressive force in order to effect a flow-limiting function.

In general, the invention features a valve for a liquefied gas lighter, having an expander-evaporator and a flow limiter for limiting flow of the liquefied gas to the expander-evaporator, the flow limiter including a rigid member, a deformable sleeve constructed of a gas permeable material surrounding the rigid member, an elastically deformable element in contact with the sleeve, and a compression member for compressing the elastically deformable element and deforming the element radially in the direction of the sleeve and the rigid member.

In preferred embodiments, the rigid member includes a support member for supporting the permeable sleeve and the expander-evaporator; the elastically deformable element includes an O-ring disposed about the sleeve, and the expander-evaporator includes a deformable and permeable element, movement of the rigid member varies the deformation and permeability of the deformable and permeable element, and an adjustment member for effecting movement of the rigid member is also provided.

The support member, along with the deformable gas permeable sleeve and the expander-evaporator which it supports form a readily accessable subassembly, thus improving the installation and maintenance of the lighter.

Moreover, since the elastically deformable element is compressed axially, and since the compressive forces which it exerts on the permeable sleeve are oriented radially, the required force is reduced, thus improving the gradual nature of this compression and hence ensuring more precise gas flow control.

The invention will now be illustratively described by way of a number of preferred embodiments, reference being had to the accompanying drawings; wherein:

DESCRIPTION OF THE PREFERRED EMBODIMENTS

Figure 1:
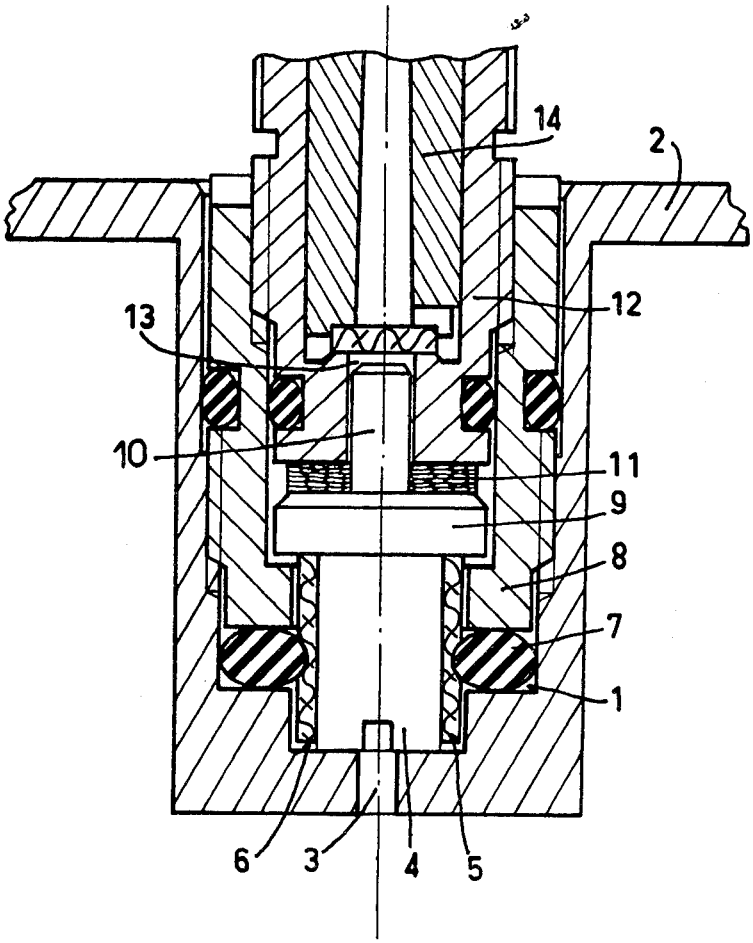
FIG. 1 is a cross-sectional view of a first embodiment of the invention, wherein the pre-regulation of the maximum flame height and the regulation of the flame proper are performed at the top of the lighter.

Referring now to FIG. 1, a valve according to the invention is mounted in a cavity 1 formed in a body 2 of a lighter. Cavity 1 communicates with a gas reservoir (not shown) through a passageway 3.

A rigid cylindrical member 4, surrounded by a gas permeable wick 5 in the form of a sleeve, is disposed in a depression 6 formed in the bottom of chamber 1.

An O-ring 7, pressed against the bottom of chamber 1 by a bushing 8 threaded into the lighter body 2 compresses wick 5 radially.

Rigid member 4 is surmounted by a support plate 9 having a stud 10 at its center. An elastic permeable washer 11, rests on plate 9 coaxially with stud 10 and is compressed by a second bushing 12 threaded into threads provided on bushing 8. The lower part of bushing 12 includes an orifice 13 which engages stud 10 and forms a passageway for the gas. A burner valve 14 is disposed in a hole provided in bushing 12.

The flame height regulation operation has two stages: in a first stage, the maximum flame height which the lighter is capable of producing is regulated, and then, in a second stage, the flame proper is adjusted to its normal operating height.

To control the maximum flame height, bushing 12 is first unscrewed to reduce the pressure on elastic permeable washer 11, and thus to reduce the loss of the charge produced thereby.

Bushing 8 is then screwed down to compress O-ring 7 which, as it deforms, in turn compresses wick 5 against rigid member 4, thus causing a loss of charge in wick 5 which corresponds to the maximum desired flame.

Since wick 5 is compressed against a rigid member, the force required to create the desired throttling effect is relatively low. Consequently, the same is true of the required deformation of O-ring 7 and hence the force exerted thereon by bushing 8 in order to cause its deformation.

It is therefore possible for a user to himself regulate the maximum height of the flame delivered by his lighter, with regard to the specific conditions to which it is subjected, for example, variations in external temperature during a trip.

In order to then adjust the flame proper to the desired operating height, bushing 12 is screwed down to compress washer 11. This creates an additional charge loss downstream from wick 5, reducing the flame proper to the desired operating height.

Figure 2:
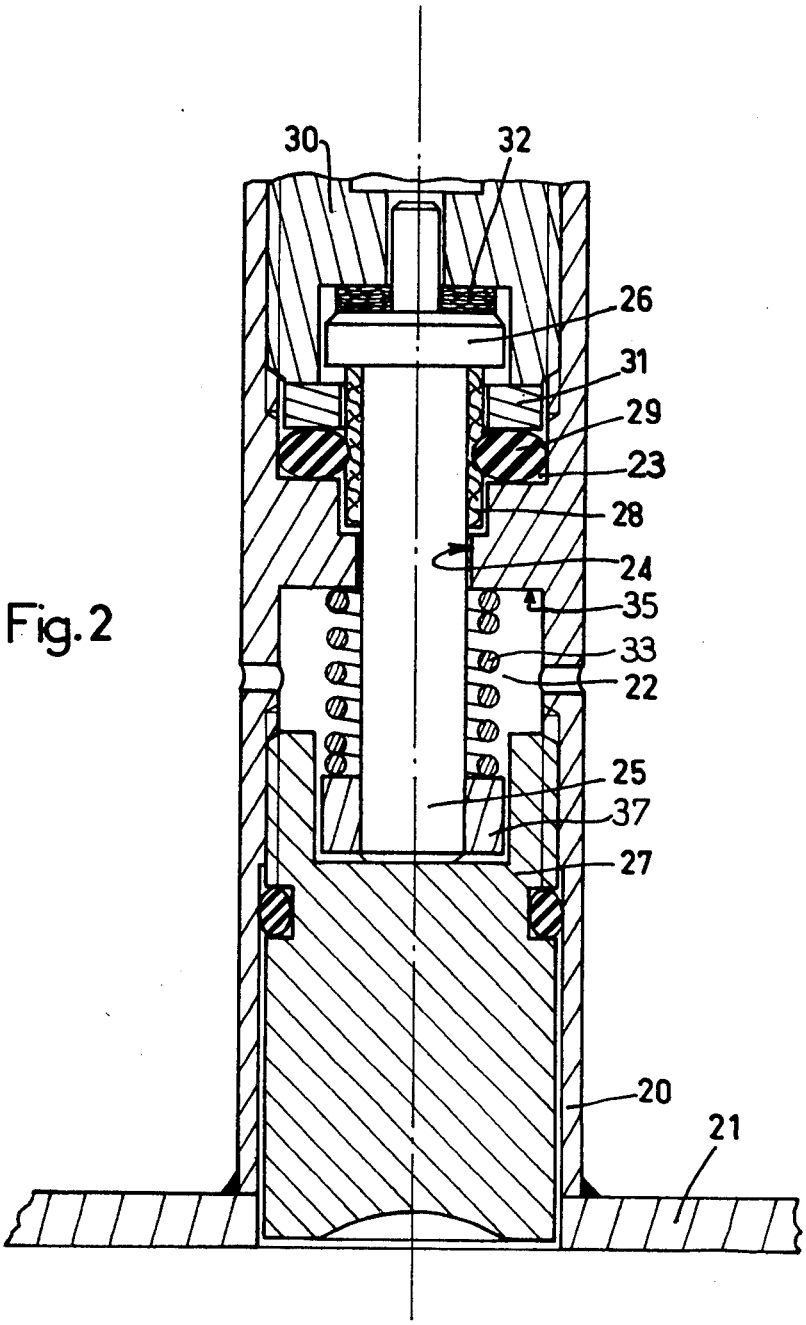
FIG. 2 is a cross-sectional view of a second embodiment of the invention, wherein the pre-regulation of the maximum flame height is effected at the top of the lighter and the flame regulation proper is controlled at the bottom of the lighter.

Referring now to FIG. 2, a second embodiment of a device according to the invention is disposed in a tube 20 provided on a body 21 of a lighter. The inside of tube 20 includes two chambers 22 and 23 which communicate with one another by a passageway 24.

A support element, consisting of a cylindrical rod 25 surmounted by a plate 26, has a base which abuts a regulating screw 27 located in chamber 22.

A sleeve 28 made of permeable foam is threaded on rod 25 and is axially compressed by an O-ring 29, which is squeezed between the bottom of chamber 23 and a rigid washer 31 by a preregulating screw 30.

An expander-evaporator is provided which consists of a permeable washer 32 disposed on plate 26 and compressed between plate 26 and screw 30. Rod 25, plate 26, sleeve 28, and washer 32 therefore constitute a subassembly which is easily installed in tube 20.

A spring 33, compressed between a flange 35 provided within tube 20 and a washer 37 which is integral with rod 25, holds rod 25 against regulating screw 27.

In this second embodiment, regulation of the maximum flame height is effected at the top of the lighter via screw 30, while the adjustment of the flame proper to the desired operating height is obtained at the bottom of the lighter, via regulating screw 27.

This device is rendered possible in simple fashion by using the rigid member (e.g., rod 25) to transmit the compressive force of screw 27 to permeable disk 32.

Figure 3:
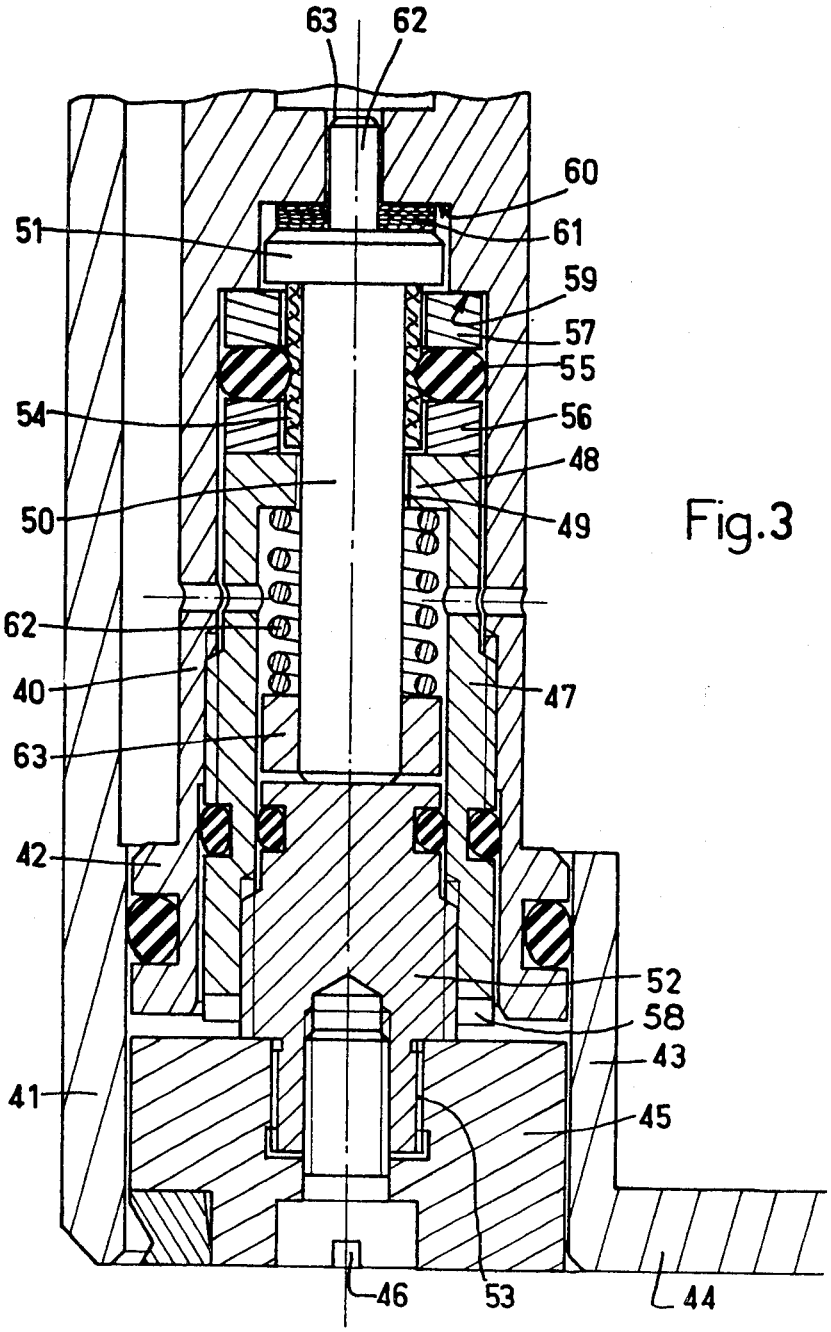
FIG. 3 is a cross-sectional view of a third embodiment of the invention, wherein the pre-regulation of the maximum flame height and the regulation of the flame proper are both controlled from the bottom of the lighter.

In a third embodiment shown in FIG. 3, in order to facilitate the regulation processes, the preregulation of the maximum flame height, and the regulation of the flame proper to the desired operating height are both effected from the bottom of the lighter.

In addition, in order to make it easier to interchange the parts of the assembly, a valve according to the invention is mounted in a tube 40 whose base 42 rests in a hole 43 in the bottom 44 of the base. A bushing 47 is screwed into the interior of tube 40. Bushing 47 includes a groove 58 to facilitate its rotation. An upper portion 48 of bushing 47 is pierced axially by a hole 49, which receives a support rod 50 in a sliding fashion. Support rod 50 is provided at its upper end with a plate 51 and abuts a regulating element 52 with its lower end. Element 52 is threaded to the inside of bushing 47 and caused to rotate by means of a control element 45, with which it is rendered rotationally integral through provision of channels 53 and a screw 46.

Inside bushing 47, a sleeve 54 made of permeable foam and serving as a flow limiter is threaded onto rod 50. Sleeve 54 is locked radially by an O-ring 55 disposed between two rigid washers 56 and 57. Rigid washer 56 abuts the upper portion 48 of bushing 47, while rigid washer 57 abuts a shoulder 59 formed on the inner surface of tube 40.

A washer 61 constructed of permeable material and serving as an expander-evaporator for the lighter, is interposed between plate 51 and a shoulder 60 formed within tube 40. Washer 61 is disposed coaxially with respect to a stud 62 which protrudes from the upper surface of plate 51 and fits into a supply channel 63 of the lighter burner.

To preregulate the maximum flame height, after removing control element 45, bushing 47 is screwed down using groove 58, to regulate the compression of O-ring 55 and thus the loss of charge in sleeve 54.

To adjust the flame proper to the desired operating height, regulating element 52 is operated through the intermediary of control element 45 in order to compress to a greater or lesser degree permeable washer 61 by movement of rod 50 and plate 51.

While our invention has been illustratively described by way of a number of preferred embodiments, various substitutions of equivalents may be effected which do not depart from the spirit and scope of the invention as set forth in the appended claims.

Having described our invention, what we claim and desire to secure by Letters Patent of the United States is:

1. A valve for a liquefied gas lighter, comprising:

expander-evaporator means for expanding and evaporating said liquefied gas; and a flow limiter for limiting flow of said liquefied gas to said expander-evaporator means, said flow limiter comprising:

a rigid member;

a deformable sleeve surrounding said rigid member, said sleeve being constructed of a gas permeable material;

an elastically deformable element in contact with said sleeve and diametrically opposed to said rigid member; and compression means for directly compressing said elastically deformable element and deforming said element radially in the direction of said sleeve and said rigid member to thereby compress said sleeve against said rigid member.

2. The valve of claim 1, wherein said rigid member includes support means for supporting said permeable sleeve and said expander-evaporator means.

3. The valve of claim 2, wherein said elastically deformable member comprises an O-ring coaxially disposed about said sleeve.

4. The valve of claim 1, 2 or 3, wherein said expander-evaporator means includes a deformable and permeable element, and wherein movement of said rigid member varies the deformation and permeability of said deformable and permeable element, and further comprising adjustment means for effecting movement of said rigid member.

* * * * *